US007263920B1

(12) United States Patent
Hamilton

(10) Patent No.: US 7,263,920 B1
(45) Date of Patent: Sep. 4, 2007

(54) TORQUE IMPACT WRENCH

(76) Inventor: Norris A Hamilton, 1320 S. 263rd, Des Moines, WA (US) 98198

( * ) Notice: Subject to any disclaimer, the term of this patent is extended or adjusted under 35 U.S.C. 154(b) by 0 days.

(21) Appl. No.: 11/303,122

(22) Filed: Dec. 15, 2005

Related U.S. Application Data

(60) Provisional application No. 60/636,383, filed on Dec. 15, 2004.

(51) Int. Cl.
*B25B 19/00* (2006.01)
*B25B 21/02* (2006.01)
*B25D 9/00* (2006.01)

(52) U.S. Cl. ..... 81/466; 173/91

(58) Field of Classification Search ..... 81/466, 81/180.1; 173/91; 29/283
See application file for complete search history.

(56) References Cited

U.S. PATENT DOCUMENTS 5,025,869 A * 6/1991 Terunuma et al. ..... 173/98
5,628,105 A * 5/1997 Fallandy et al. ..... 29/566.4
* cited by examiner

*Primary Examiner*—David B. Thomas
(74) *Attorney, Agent, or Firm*—Charles C. Logan, II

(57) ABSTRACT

A torque impact wrench having an elongated tubular metal housing. The front end of an impact wrench is secured to the rear end of the housing by a motor mount. The front end of the drive shaft of the impact wrench is inserted into the rear of an impact socket. The rear end of a drive screw is received in the front end of the impact socket. The drive screw has external threads on its rear portion and external threads on its front portion. The drive screw passes through a screw drive nut whose bore is internally threaded. The drive screw is rigidly secured in the steel housing. The front end of the steel housing has a first load disc closing that end and it removably receives the lower crimping die. A second load disc is longitudinally spaced from the first load disc and it also has a crimping die removably secured thereto. A third load disc is screwed onto the front end of the drive screw. The rotational motion of the drive shaft of the impact wrench translates into an axial motion that closes the crimping dies together as the external threads on the front end of the drive screw are threaded onto the internal threads of the screw drive nut. The torque impact wrench can be modified to straighten shafts, function as a shearing mechanism, act as a gear puller and be used for other operations.

20 Claims, 22 Drawing Sheets

SECTION B - B

SECTION A - A

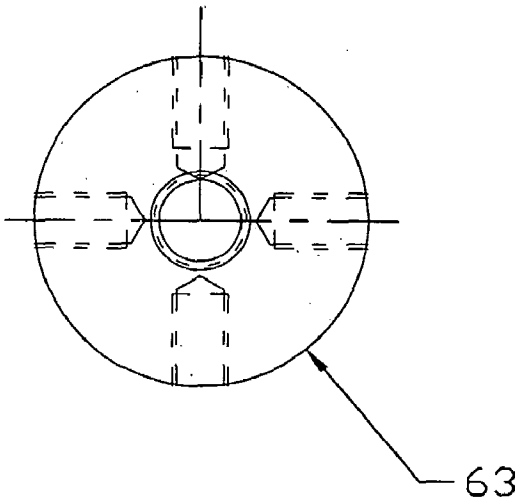
FIG 13
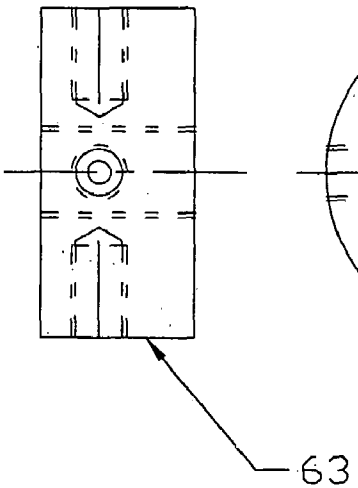
FIG 12
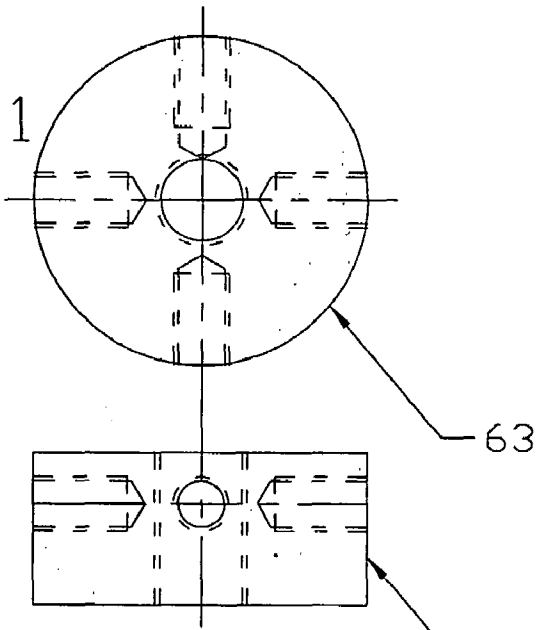
FIG 11
FIG 14

SECTION A-A

FIG 24
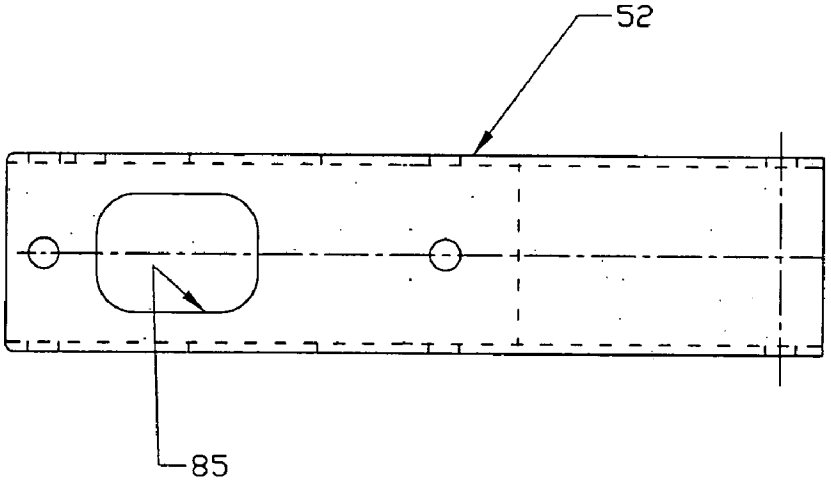
FIG 25
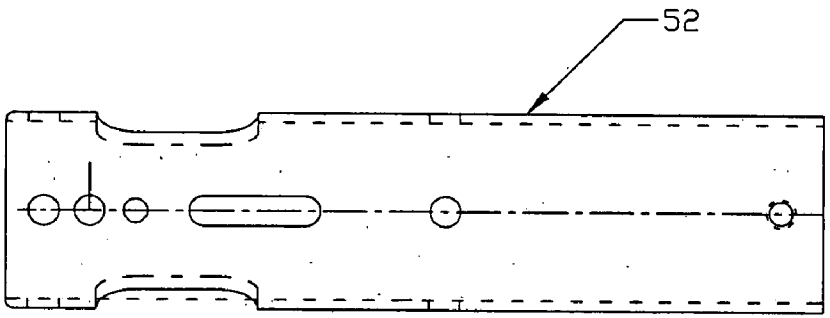
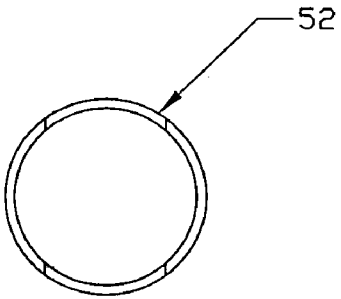
FIG 26

PORTABLE DEVICE TO
STRIGHTEN SHAFTS, CONVERTS TO
PORTABLE HIGH POWERED PRESS.

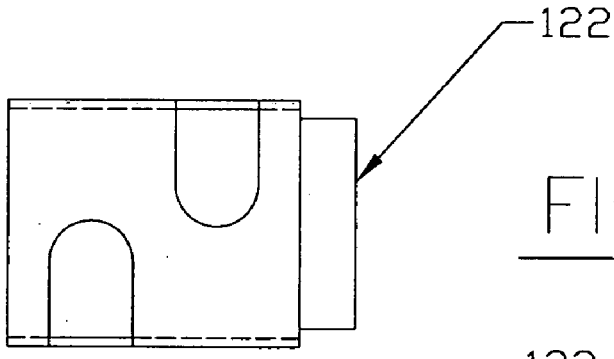
FIG. 41
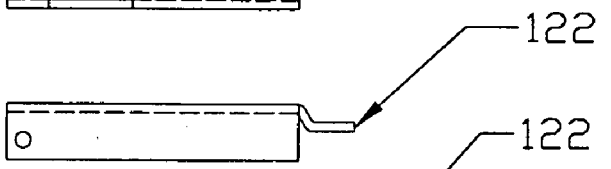
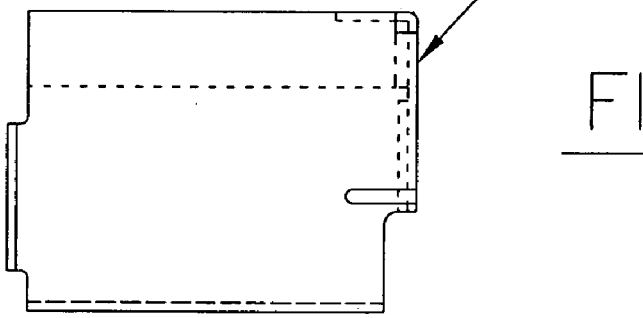
FIG. 40
FIG. 39

TORQUE IMPACT WRENCH

This application claims a priority of U.S. Provisional Application 60/636,383 filed Dec. 15, 2004.

BACKGROUND OF THE INVENTION

The invention relates to impact wrenches and more specifically to accessories that can be mounted on the front end of the impact wrenches. Impact wrenches are powered by pressurized air that rotates the drive shaft of the impact wrench. Normally a hose from a compressor is attached to a socket on the rear of the impact wrench. The impact wrenches are rated by the number of foot pound force produced by the impact wrench.

It is an object of the invention to provide a novel accessory for an impact wrench that produces a force in pounds that are more than 100 times the rated foot pound rating of the impact wrench.

It is also an object of the invention to provide a novel torque impact wrench accessory that will function as a crimping tool.

It is another object of the invention to provide an accessory for an impact wrench that can be used as a portable device to straighten shafts when it functions as a high-powered press.

It is a further object of the invention to provide a novel accessory for an impact wrench that can be used for shearing operations.

It is an additional object of the invention to provide a novel accessory for an impact wrench that hold dies for long wire splicing.

It is another object of the invention to provide a novel accessory for impact wrenches that can be used as a bearing or gear puller for automotive or machine repair.

It is also an object of the invention to provide a novel accessory for impact wrenches that can be used for removing or installing races and bushings.

SUMMARY OF THE INVENTION

One of the uses for which the torque impact wrench can be used is to crimp wires onto terminals that are attached to batteries used in automobiles and trucks. The amount of force to crimp properly is in excess of 3000 pounds. This embodiment of the torque impact wrench has been designed to produce approximately 17,000 pounds of force using a 125-foot pound impact wrench. The impact wrench drives a drive screw mechanism that advances the dies toward each other and crimps the terminal on the wires. An important part of this particular tool is the fact that it can achieve an amount force that is beyond what is normally obtained with hydraulics or air action, for the price the inventor is selling it.

The working mechanism is functioning because of a unique use of a drive screw that has threaded parts, and parts of which has no threads. This is a bolt with the threads removed in the center portion and as it is advanced it produces a load that crimps the terminal. When this is reversed, it reverses to the point where the threads disengage the screw drive nut that is being screwed onto the bolt and then continues to turn without further floating in reverse. The drive screw is spring loaded so that when the screw is turned in a clockwise direction, it can then advance for the next operation. The system is being used for producing forces that are beyond what can normally be achieved by other means of linkage.

The particular mechanism of the crimping tool could be used in various sizes and various torque values and produce larger forces that could be used for other functions such as straightening shafts, or compressing other types of terminals to a higher force. It could be used for shearing operations. It could be used for all types of applications where a large amount of force is used for cutting or forming materials.

The system could be adapted for the use of pulling gears and bearings and races from shafts and from housings. There would also seem to be other uses such as in electrical businesses where large cables are assembled and worked on in the field. The tool can be adapted for various uses where people work on trucks and cars on location.

The current crimper develops 17,000 pounds of force with a 125-foot pound torque impact wrench of 150 psi air pressure. Impact wrenches are available rated at 3000 foot pounds which would translate to 100,000 pounds of force.

DESCRIPTION OF THE DRAWINGS

FIG. 11 is a rear elevation view of the drive screw nut;

FIG. 12 is a side elevation view of the drive screw nut;

FIG. 13 is a front elevation view of the drive screw nut;

FIG. 14 is a top plan view of the drive screw nut;

FIG. 24 is a side elevation of the steel housing;

FIG. 25 is a top plan view of the steel housing;

FIG. 26 is a rear elevation view of the steel housing;

FIG. 39 is a side elevation view of the trigger guard for the fourth embodiment of the torque impact wrench;

FIG. 40 is a side elevation view of the trigger guard; and

FIG. 41 is a top plan view of the trigger guard.

DESCRIPTION OF THE PREFERRED EMBODIMENT

Figure 1:
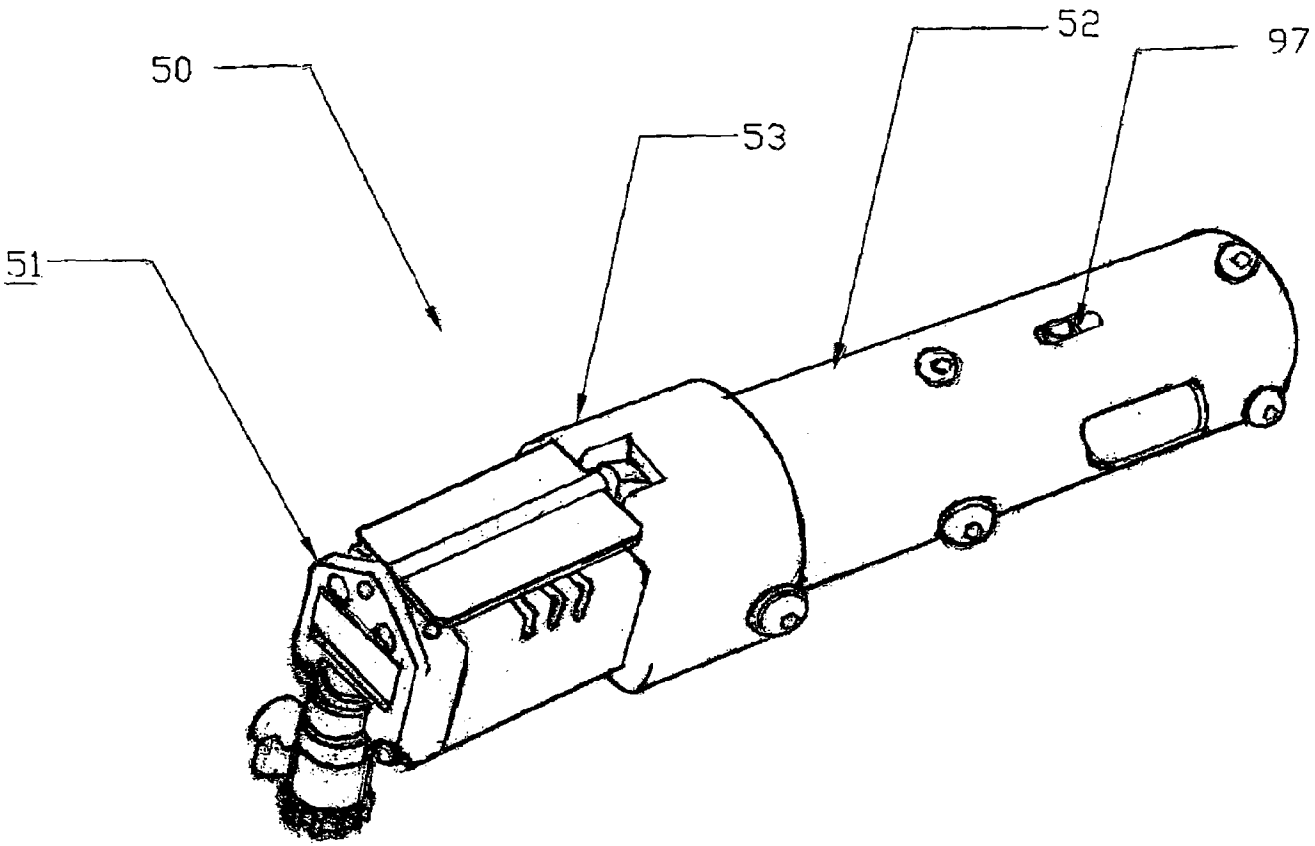
FIG. 1 is a rear perspective view of a novel torque impact wrench.
Figure 2:
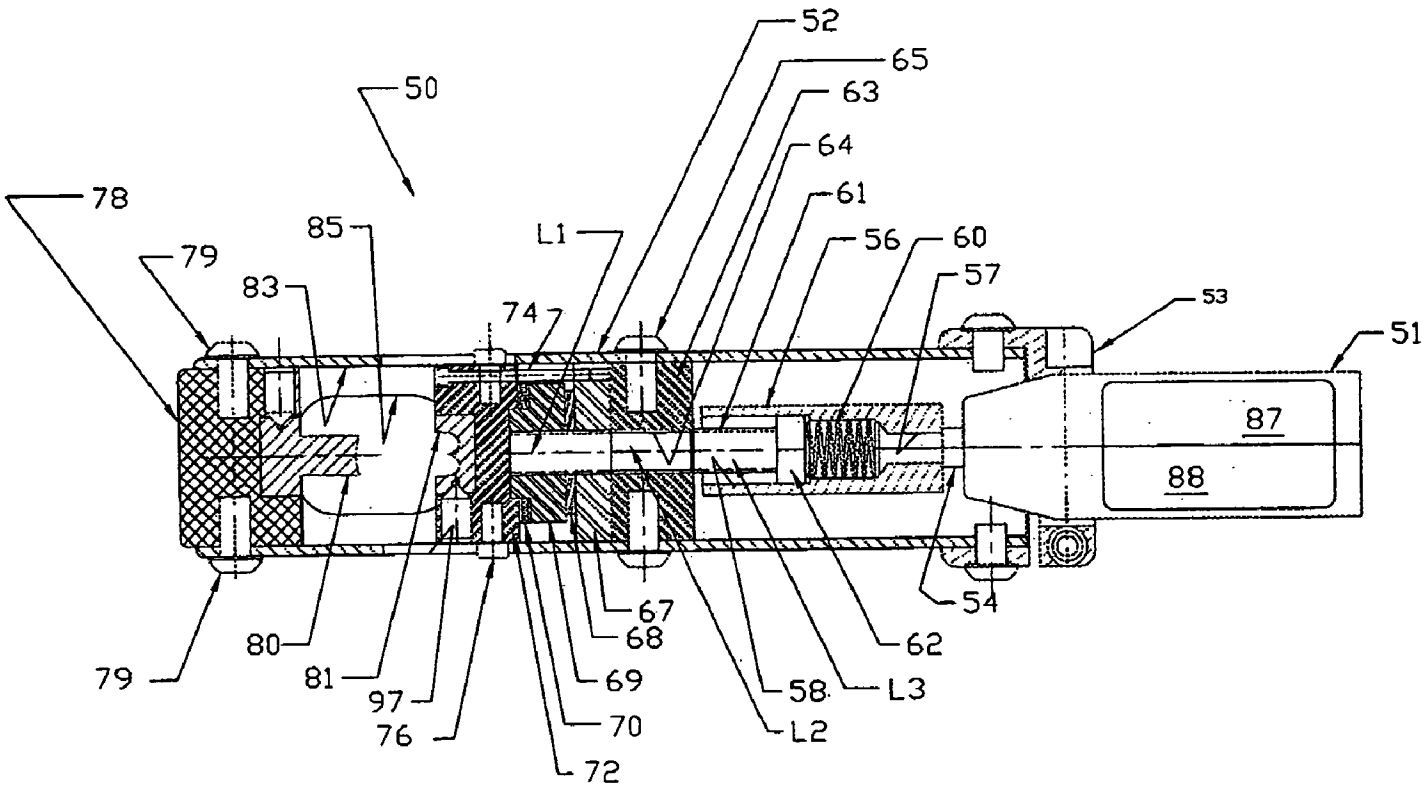
FIG. 2 is a cross sectional view of the crimper assembly.
Figure 3B:
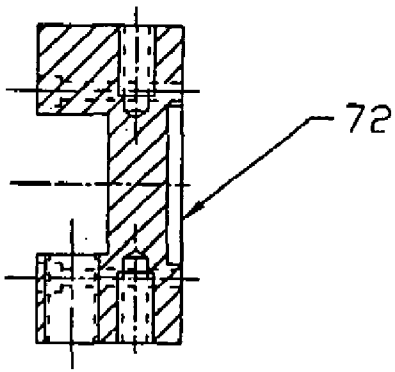
FIG. 3B is a sectional view taken along lines B-B of FIG. 3.
Figure 3:
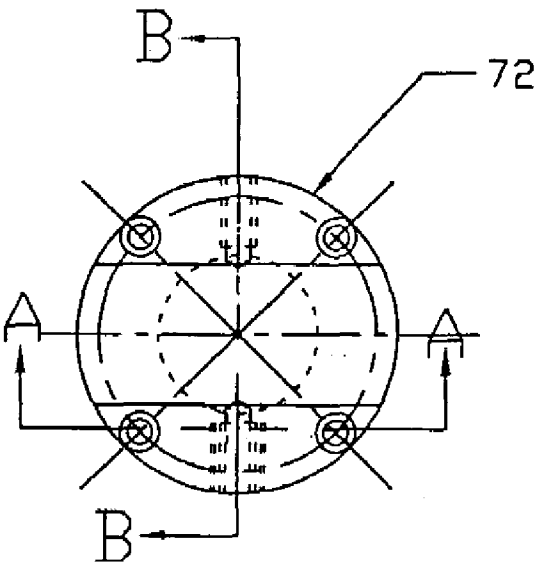
FIG. 3 is a front elevation view of the second load disc.
Figure 3A:
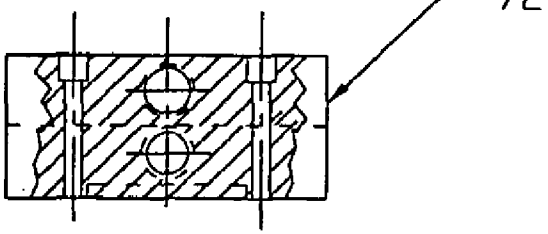
FIG. 3A is a sectional view taken along lines A-A of FIG. 3.
Figures 4, 5, 6:
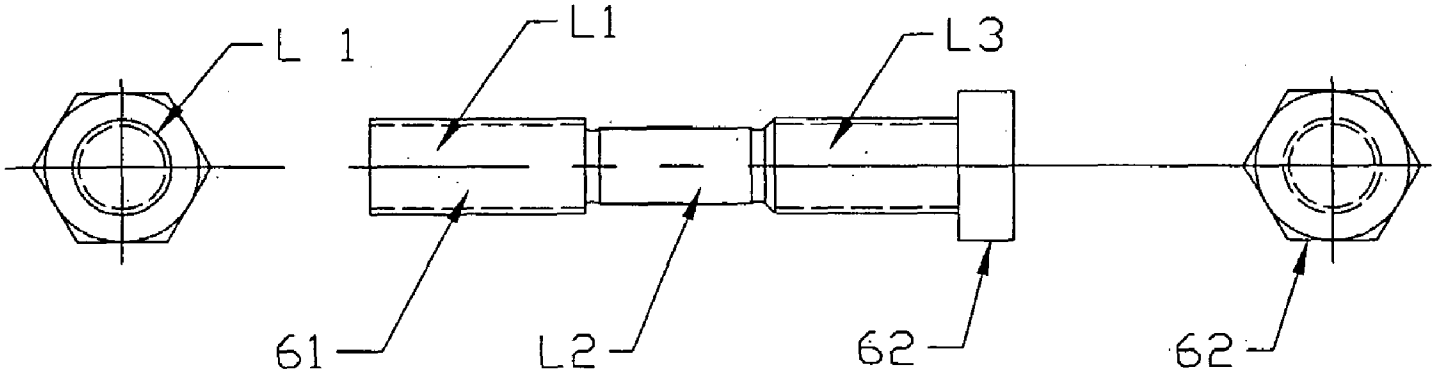
FIG. 4 is a side elevation view of the drive screw.
FIG. 5 is a front end elevation view of the drive screw.
FIG. 6 is a rear elevation view of the drive screw.
Figure 8:
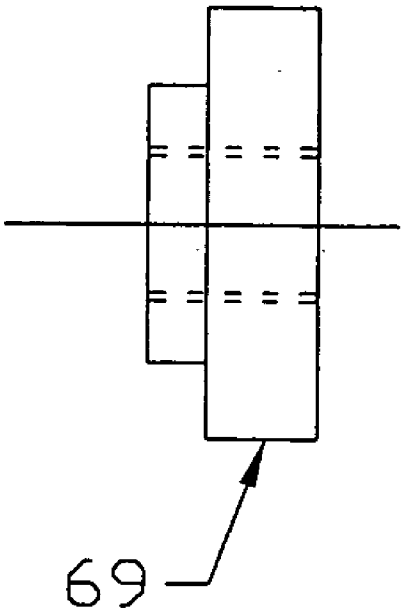
FIG. 8 is a front elevation view of the third load disc.
Figure 7:
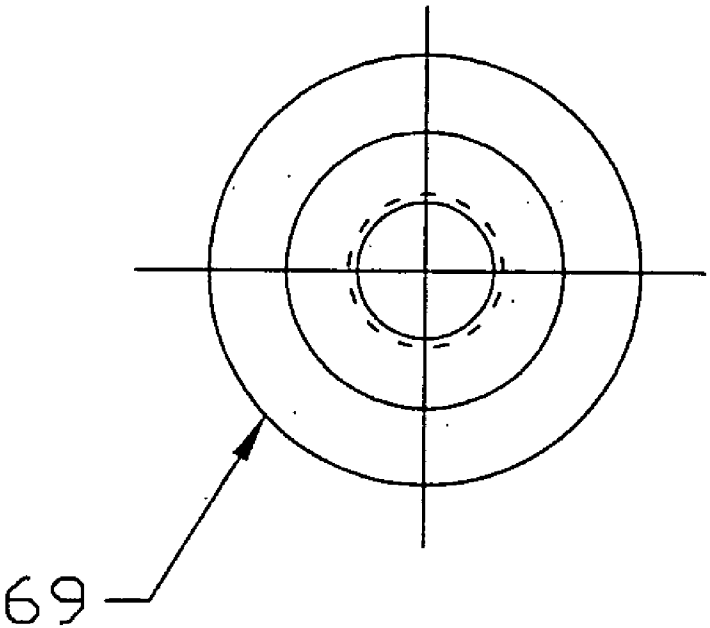
FIG. 7 is a side elevation view of the third load disc.
Figure 9:
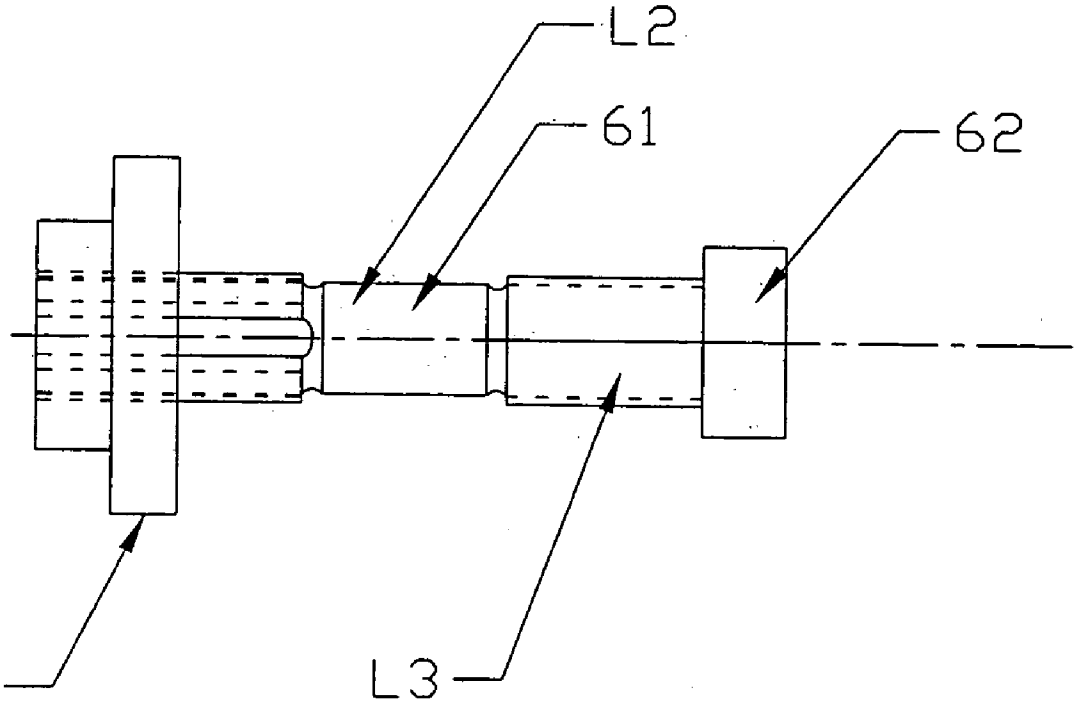
FIG. 9 is a side elevation view of the drive screw assembly.
Figure 10:
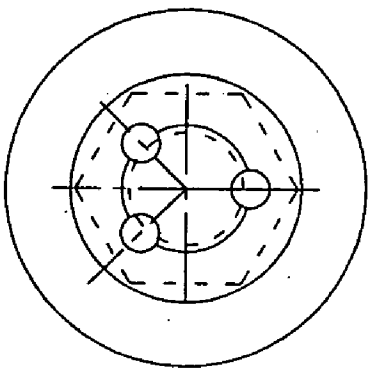
FIG. 10 is a front elevation view of the drive assembly.
Figure 17:
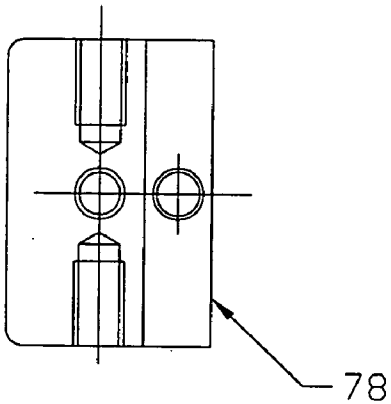
FIG. 17 is a top plan view of the first load disc.
Figure 16:
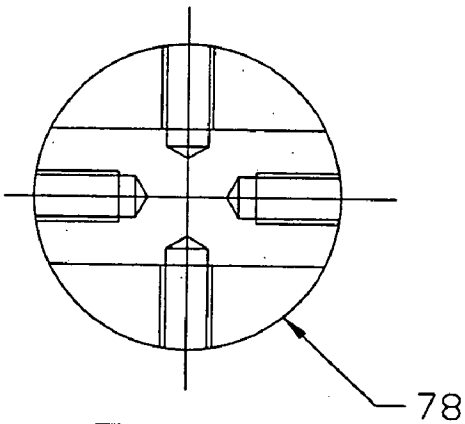
FIG. 16 is a rear elevation view of the first load disc.
Figure 15:
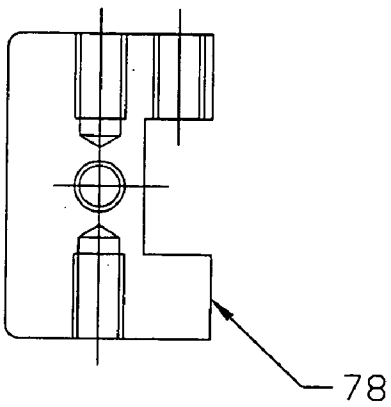
FIG. 15 is a side elevation view of the first load disc.
Figure 20:
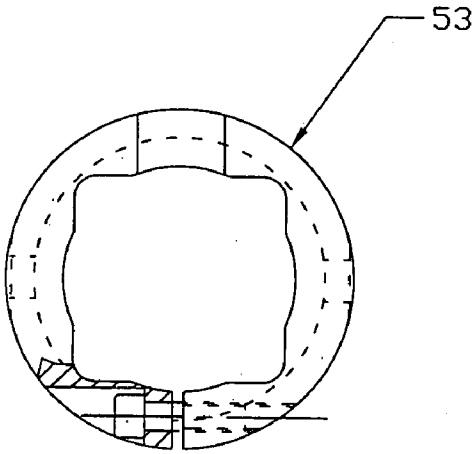
FIG. 20 is a rear elevation view of the motor mount.
Figure 19:
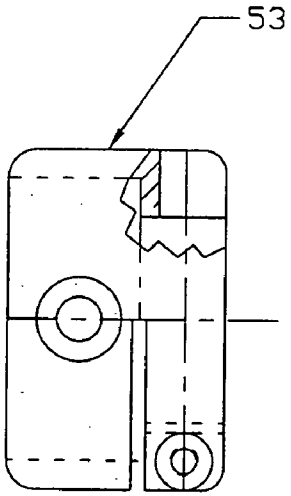
FIG. 19 is a side elevation view of the motor mount.
Figure 18:
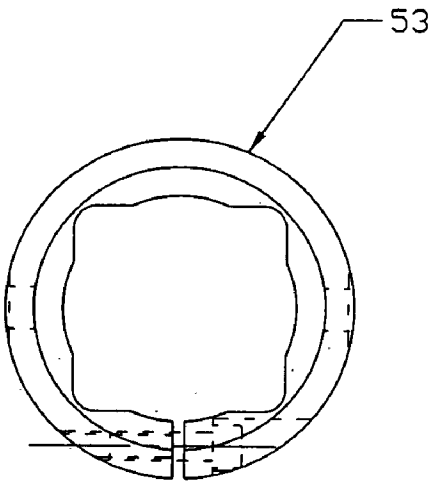
FIG. 18 is a rear elevation view of the motor mount.
Figures 21, 22, 23:
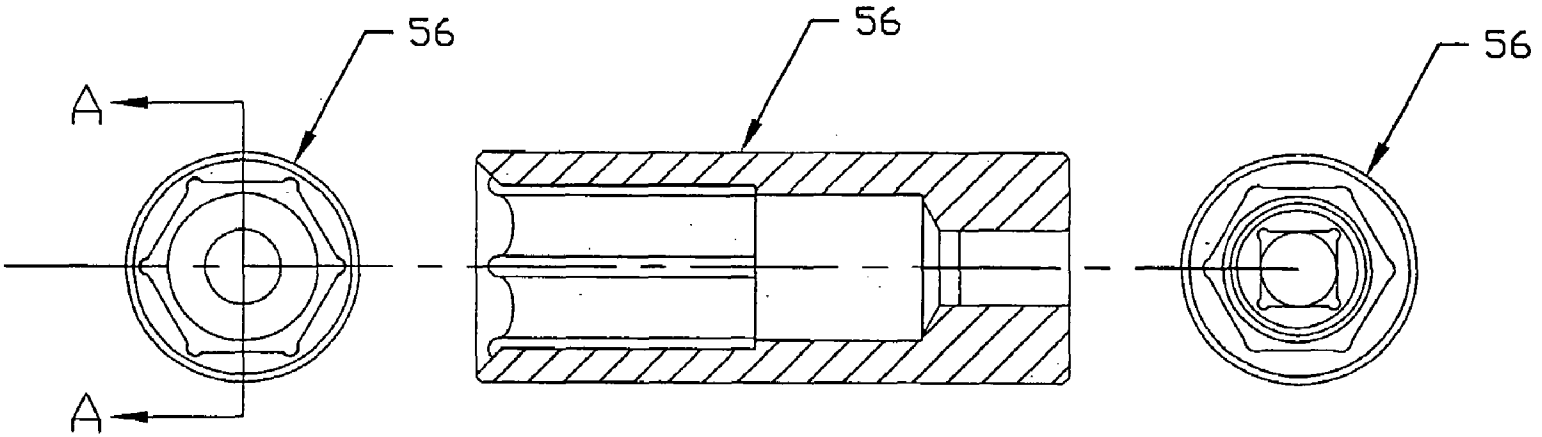
FIG. 21 is a cross sectional view of the impact deep socket.
FIG. 22 is a rear elevation view of the impact deep socket.
FIG. 23 is a front end view of the impact deep socket.
Figure 28:
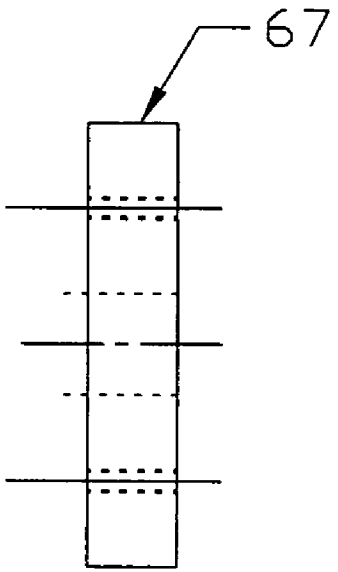
FIG. 28 is a side elevation view of the bearing retainer.
Figure 27:
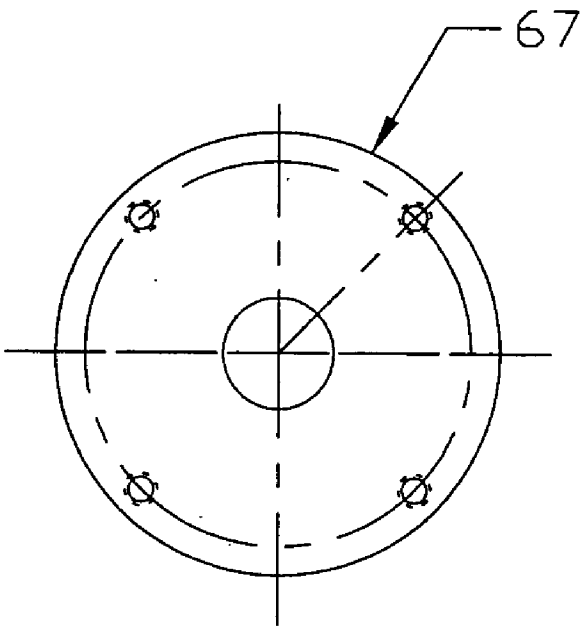
FIG. 27 is a front elevation view of the bearing retainer.

The first embodiment that uses an impact wrench with an accessory is illustrated in FIGS. 1-28 of the drawings. This accessory is described as a crimping tool and it is generally designated numeral 50. It has a butterfly impact wrench 51 that is attached to a tubular steel housing 52 by a motor mount 53. A drive shaft 54 extends from the front end of impact wrench 51. It has a square head on it (not shown) and impact sprocket 56 has a square bore 57 formed in its rear end. Its front end has a hexagon shaped bore 58 and a contact spring 60 is positioned therein. A drive screw 61 has a hexagon shaped head 62 formed at its rear end. Drive screw 60 has three distinct portions. The front end portion L1 has external threads. The intermediate portion L2 is smooth and has no threads on it. The rear portion L3 has external threads.

A screw drive nut 63 has a bore 64 that is internally threaded. Cap screws 65 rigidly secure screw drive nut 63 against any longitudinal displacement. A bearing retainer 67 has a bore allowing drive screw 61 to pass freely therethrough. A sintered bronze thrust washer 68 has a bore hole also allowing it to be positioned adjacent the front end of bearing retainer 67. Load disc 69 has an internally threaded bore and it is rigidly screwed onto the front portion L1 of drive screw 61. A thrust bearing 70 is positioned between load disc 72 and load disc 69. A plurality of longitudinally extending screws 74 secure load disc 72 to bearing retainer 67 and they would move longitudinally as a single unit. Socket cap screws 76 are threaded into the diametrically opposite sides of load disc 72. These socket cap screws extend outwardly into the area of diametrically opposed slots 77. Load disc 78 forms a front end wall for steel housing 52. It is held in place by socket cap screws 79. A bottom crimping die 80 is locked into a recess in the rear end of load disc 78. A top crimping die 81 is secured in a recess formed in the front wall of load disc 72. A chamber 83 is formed in steel housing 52 between load disc 78 and load disc 72. Diametrically opposed windows 85 allow the electrical wires to be inserted between the respective crimping dies.

Forward trigger 87 and reverse trigger 88 are positioned on the top of impact wrench 51. When trigger 87 is actuated, drive shaft 54 will be rotated clockwise causing drive screw 61 to rotate clockwise. This will cause the external threads on portion L3 to engage the internal threads in screw drive nut 63. Continued rotation will cause drive screw 61 to travel toward the front end of steel housing 62 causing the crimping dies to crimp a terminal onto the end of electrical wires that have been inserted therebetween. Actuating trigger 88 will cause the reverse action to occur.

Figure 29:
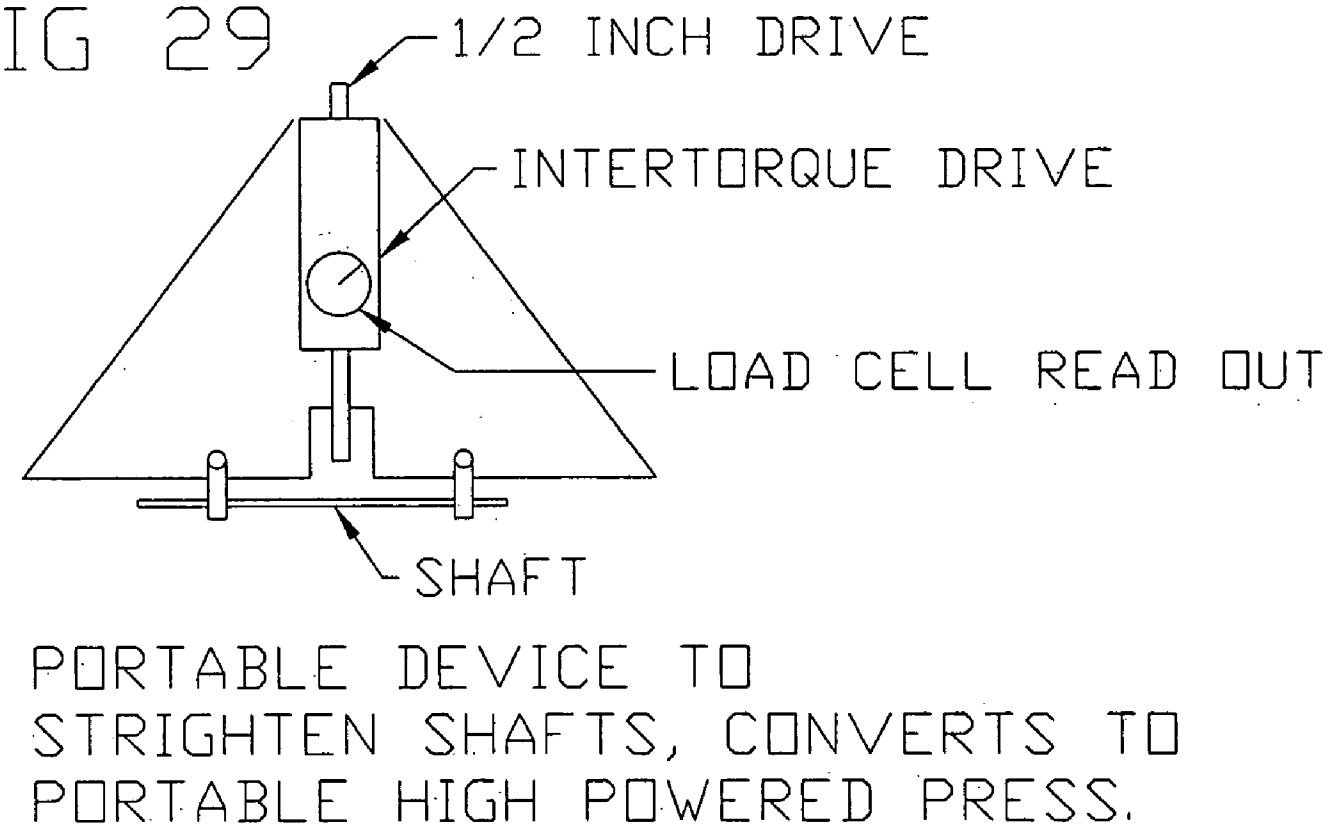
FIG. 29 is a schematic drawing of a second embodiment of the torque impact wrench being used to straighten a shaft.

FIG. 29 shows the accessory described in FIGS. 1-28 being used as a portable device to straighten shafts, and it converts to a high-powered press.

Figure 30:
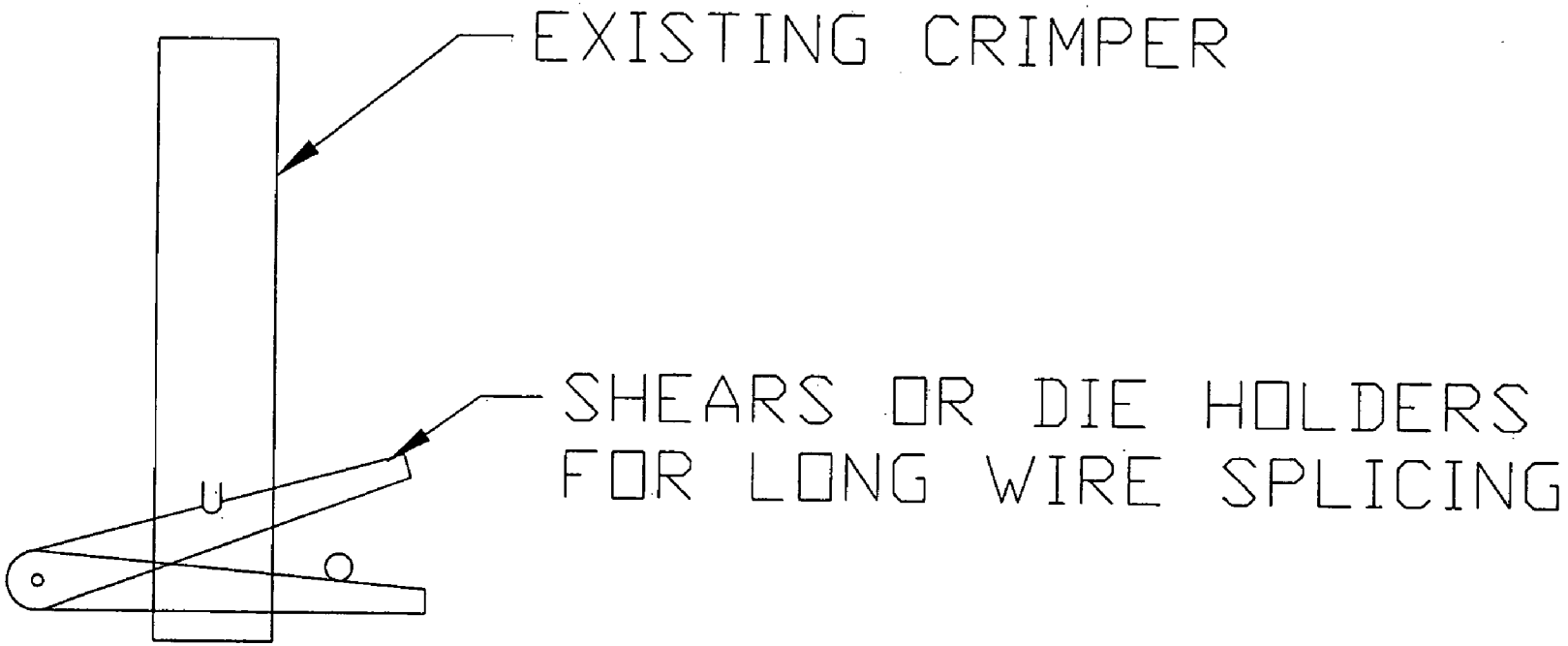
FIG. 30 is a schematic illustration of a third embodiment showing the torque impact wrench being used for shearing or inline wire splicing.

FIG. 30 is a schematic illustration showing the basic accessory structure being used to actuate shears or die holders for long wire splicing.

Figure 31:
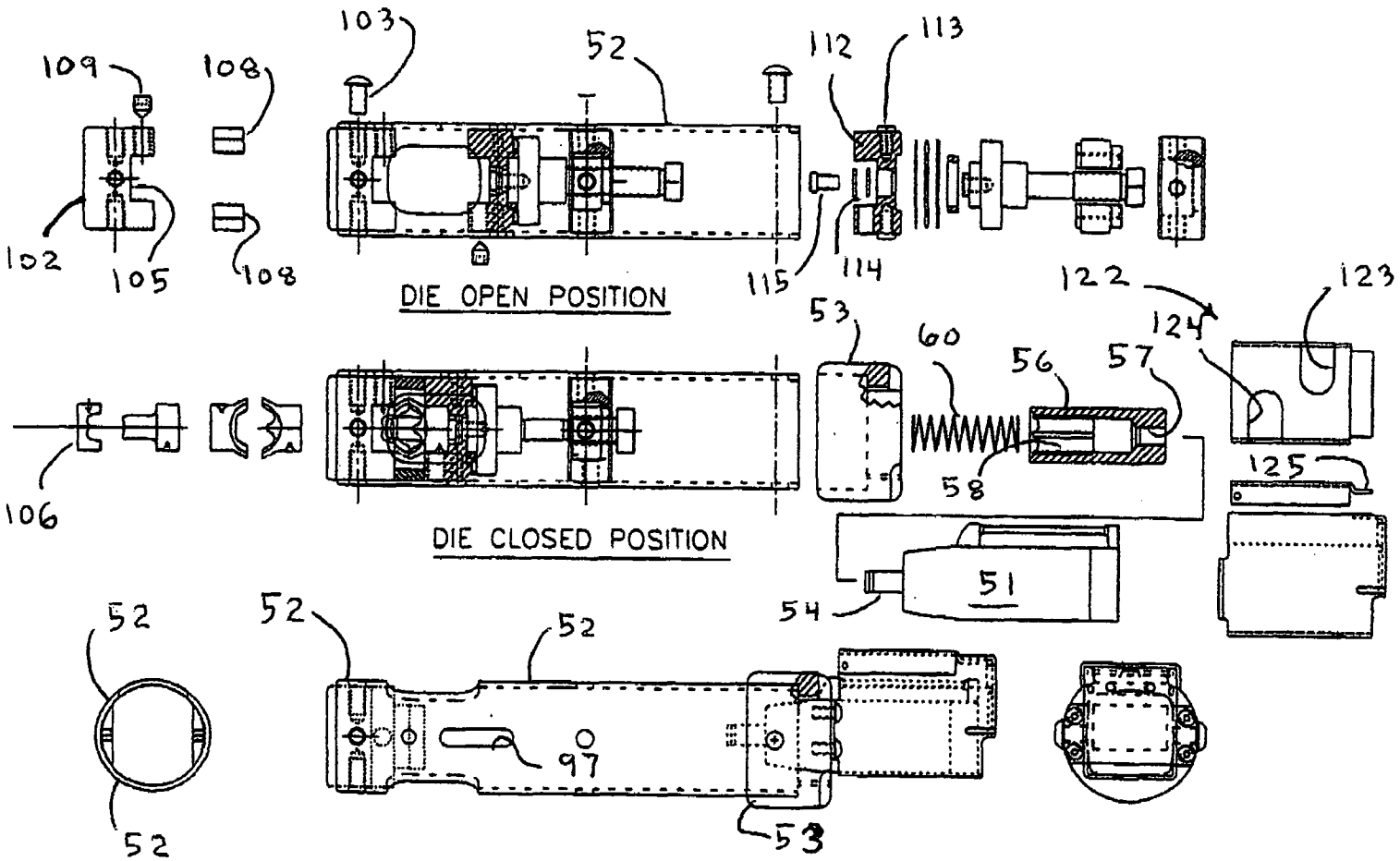
FIG. 31 is an exploded view of a fourth embodiment of the torque impact wrench.
Figure 32:
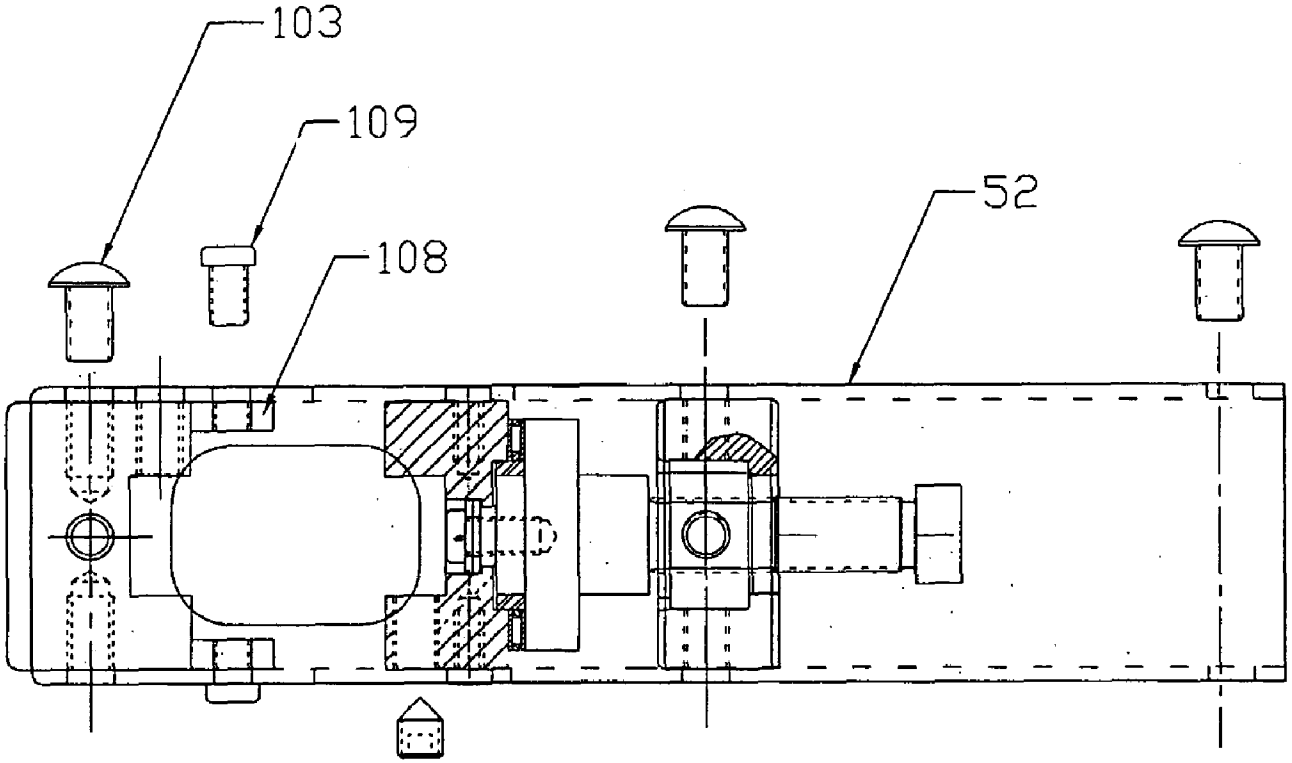
FIG. 32 is a partially exploded view of the fourth embodiment of the torque impact wrench with the impact socket and impact motor removed.
Figure 33:
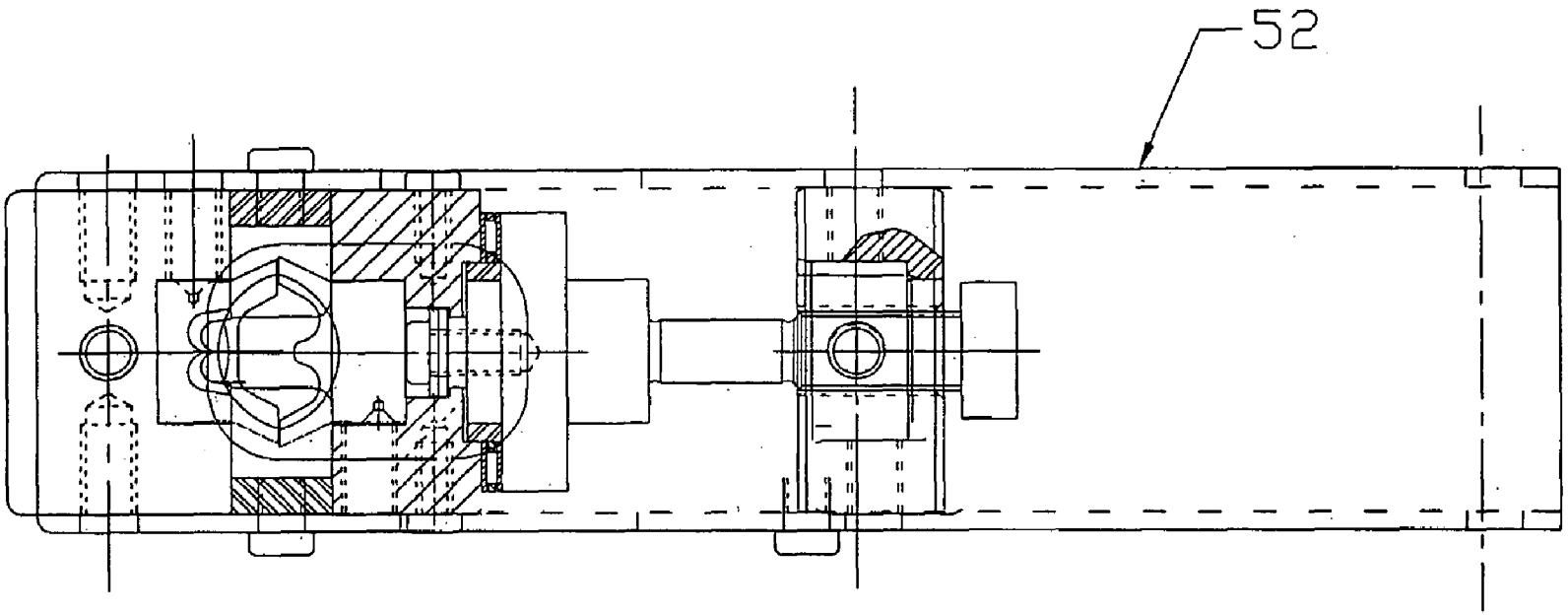
FIG. 33 is a side elevation showing the die closed position of the fourth embodiment of a torque impact wrench.
Figure 34:
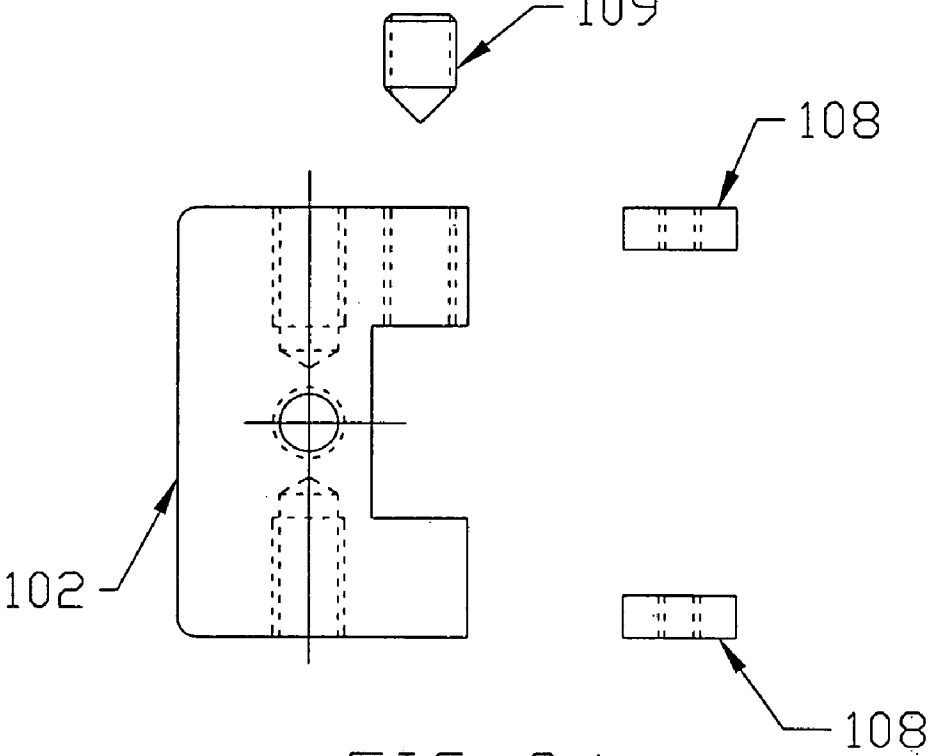
FIG. 34 is an exploded side elevation view of the first load disc.
Figure 35:
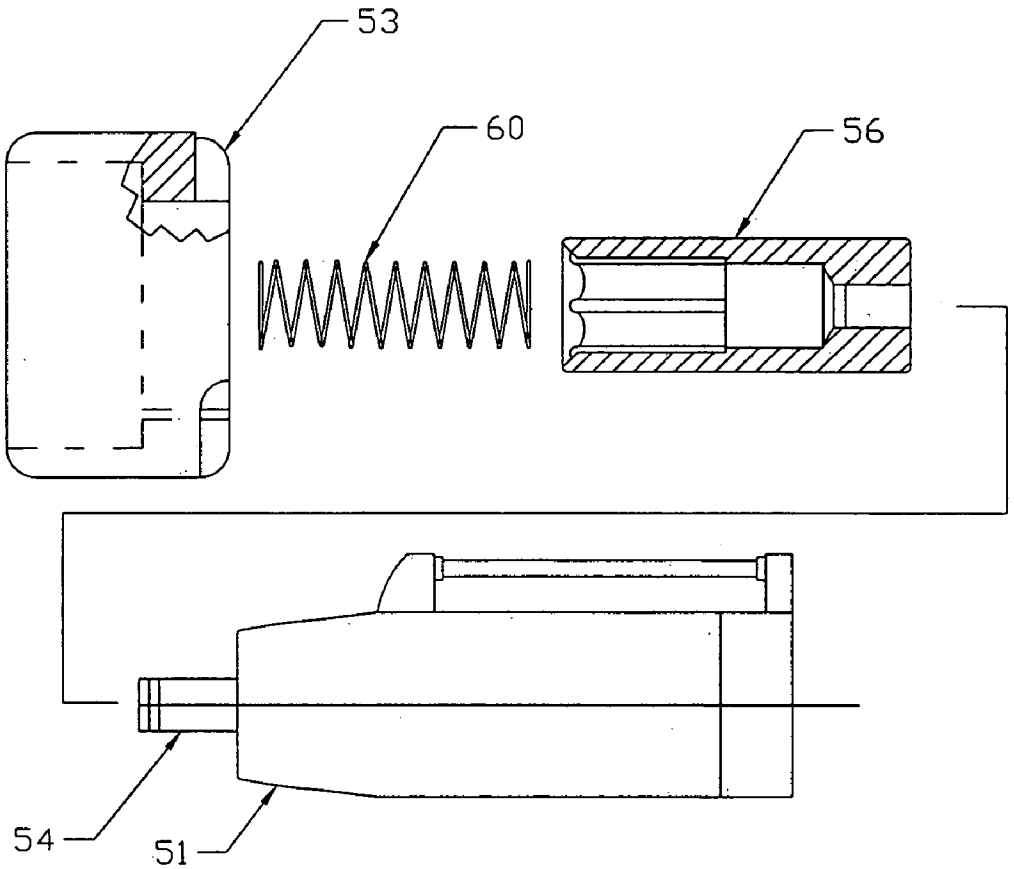
FIG. 35 is an exploded view showing the motor mount, contact spring, impact socket, and impact wrench.
Figure 36:
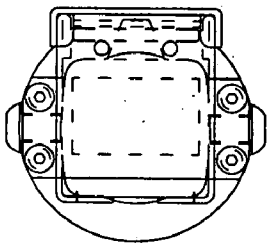
FIG. 36 shows the fourth embodiment torque impact wrench showing the impact motor assembled to the motor mount and also assembled to the steel housing.
Figure 37:
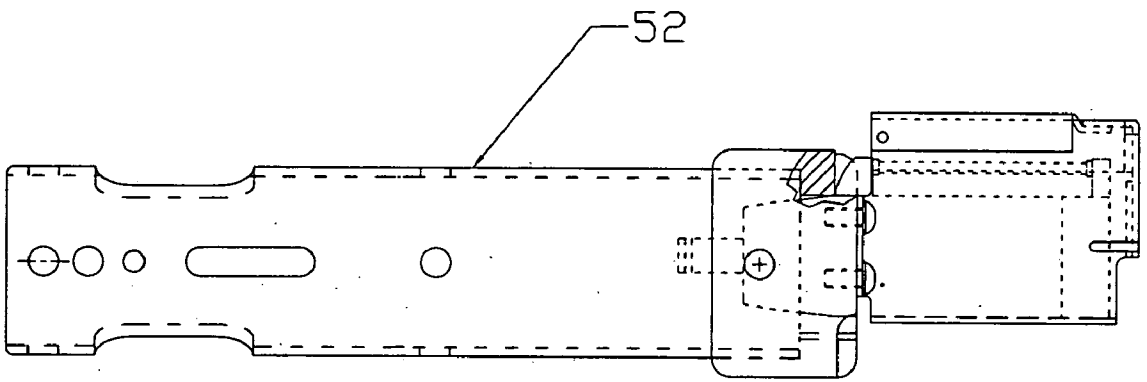
FIG. 37 is a rear elevation view of FIG. 36.
Figure 38:
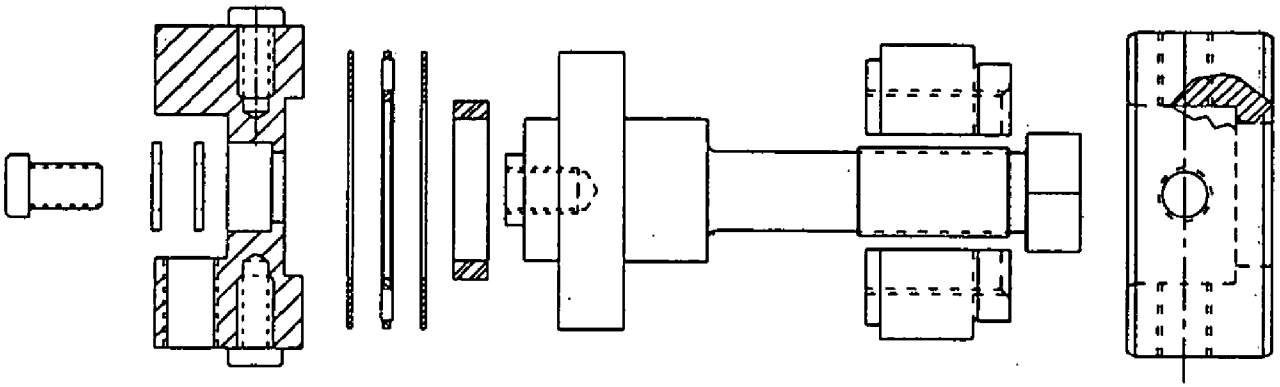
FIG. 38 is an exploded view of the internal components of the fourth torque impact wrench.

FIG. 31 is an exploded view of the different components of the fourth embodiment of an accessory for an impact wrench. Similar parts in this embodiment and in embodiment one will be identified by the same numbers. Impact motor 51 has a drive shaft 54 on its front end. The square head on the front of drive shaft 54 is inserted into bore 57 of impact socket 56. Impact socket 56 has a front bore 58 that receives contact spring 60. Motor mount 53 is used to attach impact motor 51 to the rear end of steel housing 52. A different drive screw 90 has a hexagon shaped head 91 formed on its rear end. A bearing load disc 92 is formed on its front end. An intermediate portion L2 is smooth and has no threads on its outer surface. A rear portion L3 has external threads thereon. Structures 91, 92, L2 and L3 are formed as one integral member. A split nut 94 has an upper portion 95 and a lower portion 96. These two portions have internal threads that mate with the external threads on L3. A compression ring 98 has a recess 99 formed in its front wall. When split nut 94 is compressed together around L3, this combined structure will fit into recess 99. Cap screws 100 rigidly secure this combined structure in tubular steel housing 52.

A load disc 102 telescopes into the front end of steel housing 52 and is held there by button head socket screws 103. Load disc 102 has a recess 105 in its front end for receiving a bottom crimper die 106. Travel stops 108 are held in position by set screws 109.

Load disc 112 has cap screws 113 that extend outwardly and restrict longitudinal travel in diametrically opposed slots 97. A recess 114 is formed in the front surface of load disc 112. A cap screw 115 passes through a bore in load disc 112 and screws into structure 92 while holding a plurality of washers, bearings, and solid core bearing 120. A trigger guard 122 has finger trigger slots 123 for forward travel and 124 for reverse travel. Trigger guard 122 has flanges 125 that extend from its lateral sides and allow for the trigger guard to be attached to the rear end of motor mount 53.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and the number and configuration of various components described above may be altered, all without departing from the spirit or scope of the invention as defined in the appended Claims.

What is claimed is:

1. A torque impact wrench comprising:

an elongated tubular metal housing having a front end and a rear end;

an impact wrench having a housing having a front end and a rear end; a drive shaft having an X-axis extends forwardly from said front end of said housing of said impact wrench; said impact wrench having connection means for connecting said impact wrench to a source of compressed air;

attachment means for mounting said front end of said impact wrench in said rear end of said tubular metal housing;

an elongated tubular socket having an open front end and a closed rear end; said open front end having a bore configured to removably receive a bolt shaped head of a drive screw; said closed end having a bore configured to matingly receive a head on the front end of said drive shaft;

an elongated drive screw having a longitudinally extending X-axis, a front end, a rear end having a bolt-shaped head that is telescopically received in said front end of impact socket; said drive screw having in sequence from said front end, a front portion L1, an intermediate portion L2, a rear portion L3 and said bolt-shaped head; said rear portion L3 having external threads; said intermediate portion L2 being threadless;

a screw drive nut having a longitudinally extending bore that aligns with said X-axis; said bore has internal threads; said screw drive nut being rigidly positioned within said tubular metal housing so that it is not axially movable;

a first load disc rigidly mounted in said front end of said tubular metal housing to close this end of said tubular metal housing said first load disc having a rear end;

a second load disc positioned rearwardly a predetermined distance from said rear end of first load disc in said tubular metal housing to form a work chamber between said respective load discs; said second load disc having a front end; said second load disc being capable of restricted axial travel within said tubular metal housing;

at least one window opening in said tubular metal housing adjacent said work chamber;

means for converting rotational motion of said drive screw to an axial force that drives said second load disc toward said first load disc;

work performing structure positioned within said tubular metal housing between said respective load discs.

2. A torque wrench as recited in claim 1 wherein said work performing structure is an upper crimper die and on lower crimper for crimping terminals on electrical wires.

3. A torque wrench as recited in claim 1 wherein said work performing structure has means for straightening shafts when used as a high powered press.

4. A torque wrench as recited in claim 1 wherein said work performing structure has means for inline splicing of wires.

5. A torque wrench as recited in claim 1 wherein said work performing structure has means for cutting and shearing operations.

6. A torque wrench as recited in claim 1 wherein said tubular metal housing is made of steel.

7. A torque wrench as recited in claim 1 wherein said impact wrench is a butterfly impact wrench.

8. A torque wrench as recited in claim 1 further comprising a third load disc that has a longitudinally extending internally threaded bore; said third load disc being threadably secured on said externally threads first portion L1 of said drive screw.

9. A torque wrench as recited in claim 8 further comprising a disc-shaped bearing retainer having a longitudinally extending bore; said bearing retainer being positioned on said drive screw between said screw drive nut and said second load disc.

10. A torque wrench as recited in claim 9 further comprising a plurality of longitudinally extending screws securing said second load disc to said bearing retainer.

11. A torque impact wrench comprising:

an elongated tubular metal housing having a front end and a rear end;

an impact wrench having a housing having a front end and a rear end; a drive shaft having an X-axis extends forwardly from said front end of said housing of said impact wrench; said impact wrench having connection means for connecting said impact wrench to a source of compressed air;

attachment means for mounting said front end of said impact wrench in said rear end of said tubular metal housing;

an elongated tubular socket having an open front end and a closed rear end; said open front end having a bore configured to removably receive a bolt shaped head of a drive screw; said closed end having a bore configured to matingly receive a head on the front end of said drive shaft;

an elongated drive screw having a longitudinally extending X-axis, a front end, a rear end having a bolt-shaped head that is telescopically received in said front end of impact socket; said drive screw having in sequence from said front end, a front bearing load disc, an intermediate portion L2, a rear portion L3 and said bolt-shaped head; said rear portion L3 having external threads; said intermediate portion L2 being threadless;

a split screw drive nut having a longitudinally extending split bore that aligns with said X-axis; said split bore has internal threads; said screw drive nut being rigidly positioned within said tubular metal housing so that it is not axially movable;

a first load disc rigidly mounted in said front end of said tubular metal housing to close this end of said tubular metal housing; said first load disc having a rear end;

a second load disc positioned rearwardly a predetermined distance from said rear end of first load disc in said tubular metal housing to form a work chamber between said respective load discs; said second load disc having a front end; said second load disc being capable of restricted axial travel within said tubular metal housing;

at least one window opening in said tubular metal housing adjacent said work chamber;

means for converting rotational motion of said drive screw to an axial force that drives said second load disc toward said first load disc;

work performing structure positioned within said tubular metal housing between said respective load discs.

12. A torque wrench as recited in claim 11 wherein said work performing structure is an upper crimper die and on lower crimper for crimping terminals on electrical wires.

13. A torque wrench as recited in claim 11 wherein said work performing structure has means for straightening shafts when used as a high powered press.

14. A torque wrench as recited in claim 11 wherein said work performing structure has means for inline splicing of wires.

15. A torque wrench as recited in claim 11 wherein said work performing structure has means for cutting and shearing operations.

16. A torque wrench as recited in claim 11 further comprising travel stop means positioned in said tubular metal housing between said first load disc and said second load disc to limit rearward travel of said second load disc.

17. A torque wrench as recited in claim 11 wherein said front load disc, said intermediate portion L2, said rear portion L3 and said bolt-shaped head of said drive screw are integral formed as solid screw drive.

18. A torque wrench as recited in claim 11 further comprising a trigger guard mounted over said impact motor.

19. A torque wrench as recited in claim 18 wherein said trigger guard is attached to said motor mount.

20. A torque wrench as recited in claim 18 wherein said trigger guard has a cutout for finger insertion for driving said drive shaft of said impact motor forwardly and a cutout for driving said drive shaft in reverse.

* * * * *